US012281864B2

(12) United States Patent
Carlock

(10) Patent No.: US 12,281,864 B2
(45) Date of Patent: Apr. 22, 2025

(54) RADIATOR CLEANING ASSEMBLY

(71) Applicant: Gary Carlock, Emmett, ID (US)

(72) Inventor: Gary Carlock, Emmett, ID (US)

( * ) Notice: Subject to any disclaimer, the term of this patent is extended or adjusted under 35 U.S.C. 154(b) by 328 days.

(21) Appl. No.: 17/988,455

(22) Filed: Nov. 16, 2022

(65) Prior Publication Data

US 2024/0159484 A1 May 16, 2024

(51) Int. Cl.
*F28G 1/16* (2006.01)

(52) U.S. Cl.
CPC ..... *F28G 1/166* (2013.01)

(58) Field of Classification Search
None
See application file for complete search history.

(56) References Cited

U.S. PATENT DOCUMENTS 2,623,791 A 12/1952 Schmitz
4,451,069 A * 5/1984 Melone ..... F16L 37/0842 285/86
4,600,153 A 7/1986 Stone
D601,223 S 9/2009 Tremblay
8,573,237 B2 11/2013 Crum
2008/0120802 A1 5/2008 Harvey
2012/0216369 A1 8/2012 Vinci
2013/0105603 A1 5/2013 Krankowsky

FOREIGN PATENT DOCUMENTS

CA 2793330 4/2013

* cited by examiner

*Primary Examiner* — Rita P Adhlakha

(57) ABSTRACT

A radiator cleaning assembly includes a blowing tube having a tubular portion and a flattened fin portion facilitating the fin portion to be positioned adjacent to a radiator without damaging the radiator. The fin portion has an air hole extending into an interior of the blowing tube. A valve is integrated into the blowing tube and the valve is positioned on the tubular portion. The valve is positionable in an open condition to pass air into the blowing tube and the valve is positionable in a closed condition to inhibit air from passing into the blowing tube. An air hose is fluidly coupled to the valve and the air hose is fluidly coupled to a source of compressed air to deliver compressed air to the valve. The valve delivers the compressed air to the air hole in the blowing tube to dislodge dirt and debris from the radiator.

6 Claims, 5 Drawing Sheets

RADIATOR CLEANING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to cleaning devices and more particularly pertains to a new cleaning device for dislodging dirt and debris from a radiator. The device includes a blowing tube that has a fin portion that is flattened and an air hole extending through the fin portion. The device includes a valve attached to the blowing tube which is attachable to a source of compressed air. In this way the compressed air can pass outwardly through the air hole in the fin portion to dislodge dirt and debris from the radiator when the blowing tube is positioned next to the radiator.

(2) Description of Related Art Including Information Disclosed Under 37 CFR 1.97 and 1.98

The prior art relates to cleaning devices including a radiator cleaner that comprises a tube with an angled surface positioned adjacent to a distal end of the tube and an air hole extending through the angled surface. The prior art discloses a radiator cleaning tool that comprises a tubular wand that is attachable to a fluid source and which has a plurality of jet ports for spraying fluid. The prior art discloses a cleaning tool that includes a tube which is curved at an end of the tube thereby facilitating the end of the tube to be pointed at a radiator and a valve that is attachable to a fluid source. The prior art discloses a cleaning wand that has a plurality of air holes and a threaded end for attaching to a water hose. The prior art discloses a blowing tube that has a plurality of air holes and a plug that is removable from an end of the blowing tube for either blowing air through the air holes or through the end of the blowing tube. The prior art discloses a blowing tube that has an air aperture, a valve attached to the blowing tube and a nipple attached to the valve.

BRIEF SUMMARY OF THE INVENTION

An embodiment of the disclosure meets the needs presented above by generally comprising a blowing tube that has a tubular portion and a fin portion that is flattened thereby facilitating the fin portion to be positioned adjacent to a radiator without damaging the radiator. The fin portion has an air hole extending into an interior of the blowing tube. A valve is integrated into the blowing tube and the valve is positioned on the tubular portion. The valve is positionable in an open condition to pass air into the blowing tube and the valve is positionable in a closed condition to inhibit air from passing into the blowing tube. An air hose is fluidly coupled to the valve and the air hose is fluidly coupled to a source of compressed air to deliver compressed air to the valve. The valve delivers the compressed air to the air hole in the blowing tube to dislodge dirt and debris from the radiator.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
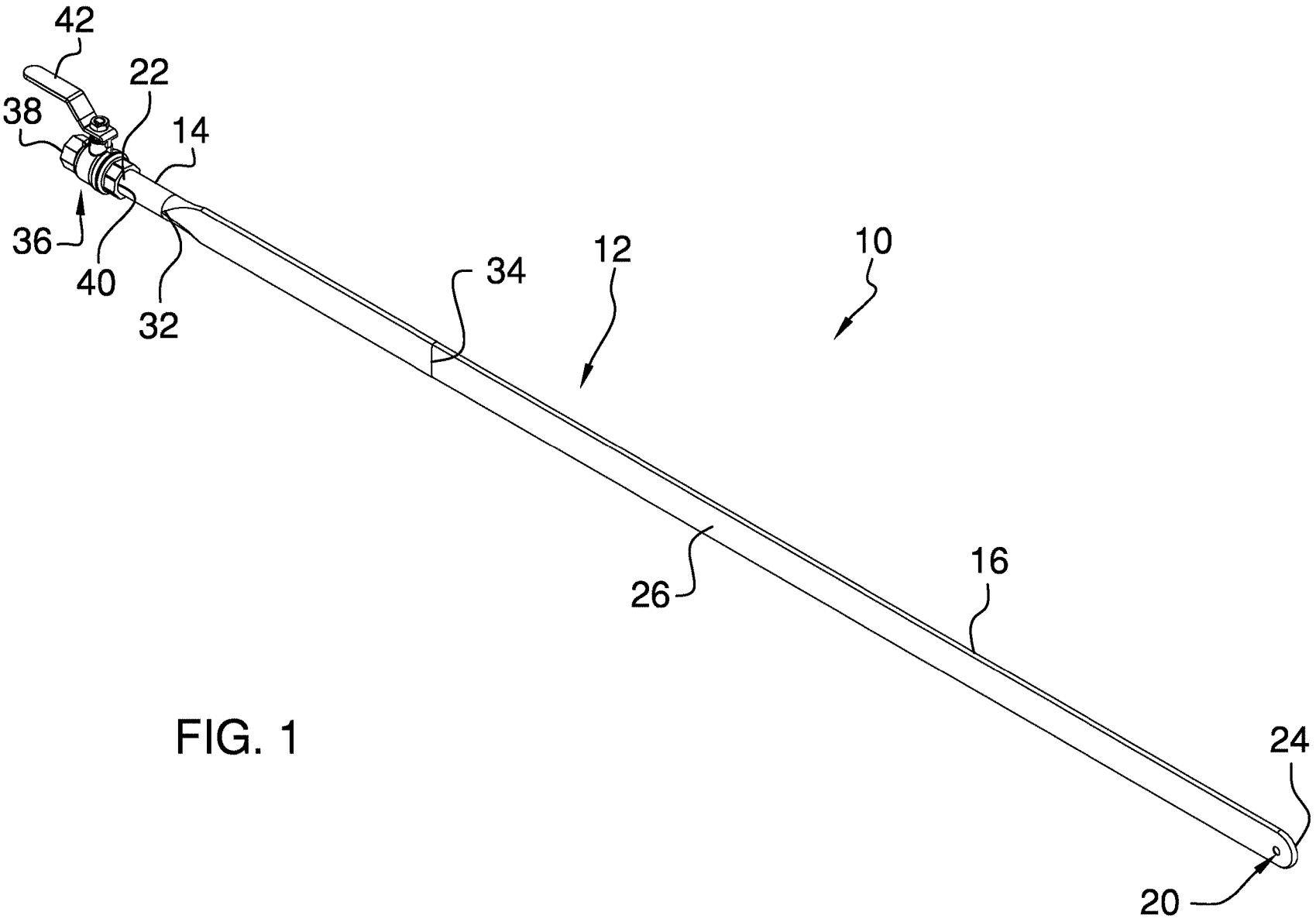
FIG. 1 is a perspective view of a radiator cleaning assembly according to an embodiment of the disclosure.
Figure 2:
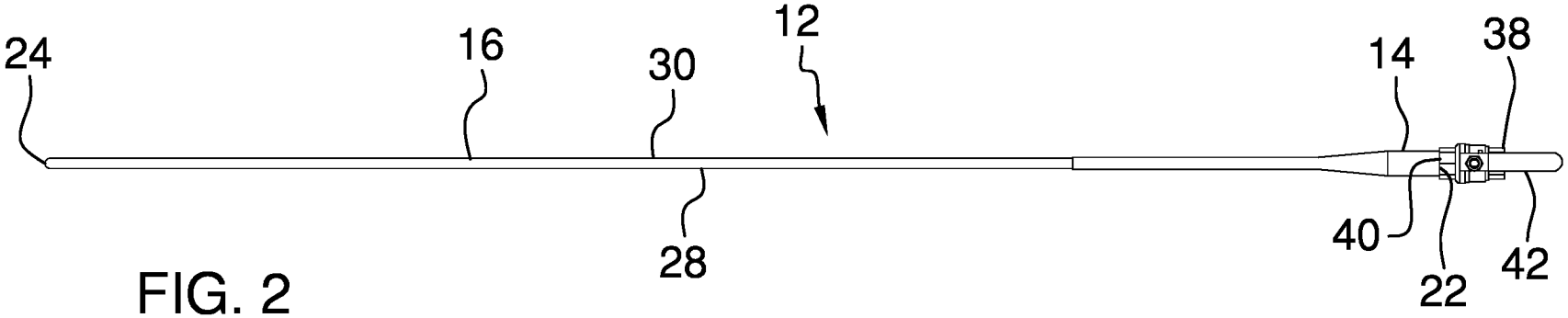
FIG. 2 is a left side view of an embodiment of the disclosure.
Figure 3:
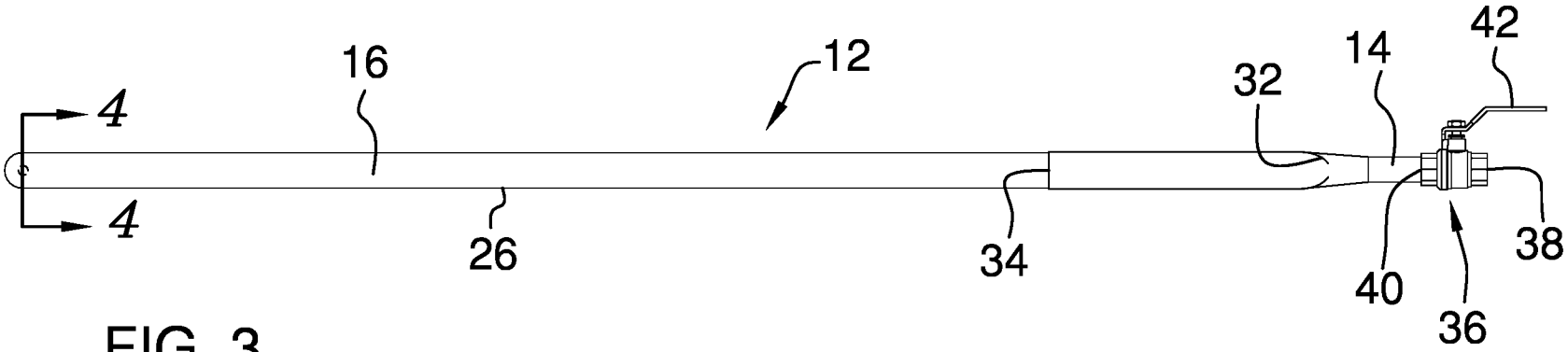
FIG. 3 is a top view of an embodiment of the disclosure.
Figure 4:
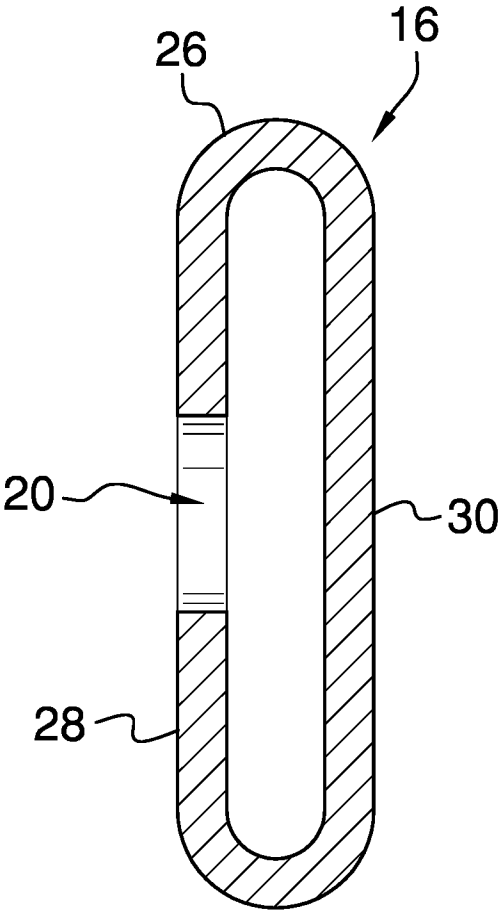
FIG. 4 is a cross sectional view taken along line 4-4 of FIG. 3 of an embodiment of the disclosure.
Figure 5:
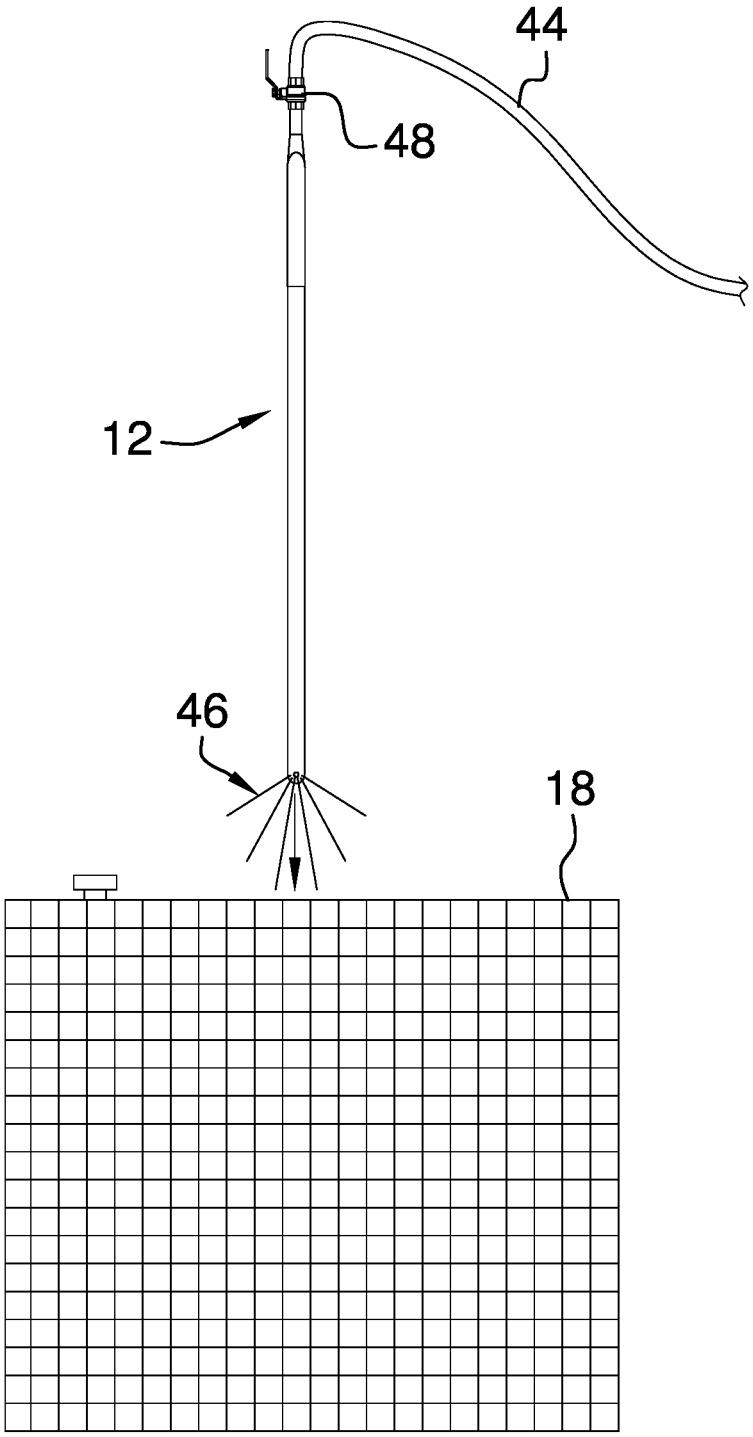
FIG. 5 is a perspective in-use view of an embodiment of the disclosure.

With reference now to the drawings, and in particular to FIGS. 1 through 6 thereof, a new cleaning device embodying the principles and concepts of an embodiment of the disclosure and generally designated by the reference numeral 10 will be described.

As best illustrated in FIGS. 1 through 6, the radiator cleaning assembly 10 generally comprises a blowing tube 12 that has a tubular portion 14 and a fin portion 16 that is flattened thereby facilitating the fin portion 16 to be positioned adjacent to a radiator 18 without damaging the radiator 18. The radiator 18 may be associated with an internal combustion engine in a motorized vehicle, for example, or other type of radiator 18 employed for cooling an internal combustion engine. The fin portion 16 has an air hole 20 extending into an interior of the blowing tube 12 and the air hole 20 is distally positioned with respect to the tubular portion 14.

The blowing tube 12 has a first end 22, a second end 24 and an outer wall 26 extending between the first end 22 and the second end 24. The first end 22 is associated with the tubular portion 14 and the first end 22 is open. The second end 24 is associated with the fin portion 16 and the second end 24 is closed. The outer wall 26 associated with the tubular portion 14 is continuously arcuate about an axis extending between the first end 22 and the second end 24 such that the tubular portion 14 defines a cylindrical shape. The outer wall 26 associated with the fin portion 16 is flattened to define a first lateral side 28 of the outer wall 26 associated with the fin portion 16 and a second lateral side 30 of the outer wall 26 associated with the fin portion 16. The first lateral side 28 lies on a plane that is oriented parallel with the second lateral side 30 having the first lateral side 28 being spaced from the second lateral side 30.

The outer wall 26 has a threshold 32 between the tubular portion 14 and the fin portion 16. Each of the first lateral side 28 and the second lateral side 30 extends between the threshold 32 and the second end 24 of the blowing tube 12. Additionally, the threshold 32 is positioned closer to the first end 22 than the second end 24. The air hole 20 extends through the first lateral side 28 and the air hole 20 is positioned proximate the second end 24. The second end 24 is rounded thereby inhibiting the second end 24 from damaging the radiator 18 when the second end 24 inadvertently comes into contact with the radiator 18. The blowing tube 12 may be comprised of galvanized metal or other type of rigid material that can resist being deformed by compressed air.

A sleeve 34 is provided and the sleeve 34 is wrapped around the blowing tube 12. The sleeve 34 is positioned to extend across the threshold 32 of the outer wall 26 between the tubular portion 14 and the fin portion 16 and the sleeve 34 conforms to a shape of the outer wall 26. The sleeve 34 may comprise heat shrink tubing that has been heated to shrink around the outer wall 26.

A valve 36 is integrated into the blowing tube 12 and the valve 36 is positioned on the tubular portion 14. The valve 36 is positionable in an open condition to pass air into the blowing tube 12. Conversely, the valve 36 is positionable in a closed condition to inhibit air from passing into the blowing tube 12. The valve 36 has an input 38 and an outlet 40 and the outlet 40 is fluidly coupled to the first end 22 of the blowing tube 12. Furthermore, the valve 36 has a handle 42 that is rotatably attached to the valve 36. The handle 42 is in mechanical communication with the valve 36 for urging the valve 36 between the open condition and the closed condition when the handle 42 is manipulated. The valve 36 may comprise a ball valve or other type of air valve which that can be adjusted to pass a volume of air ranging between a minimum volume of air and a maximum volume of air.

An air hose 44 is fluidly coupled to the valve 36 and the air hose 44 is fluidly coupled to a source of compressed air 46 to deliver compressed air to the valve 36. The valve 36 delivers the compressed air to the air hole 20 in the blowing tube 12 when the valve 36 is in the open condition. In this way the compressed air can dislodge dirt and debris from the radiator 18 when the blowing tube 12 is positioned next to the radiator 18. Additionally, the air hose 44 has a primary end 48 that is fluidly coupled to the inlet of the valve 36.

Figure 6:
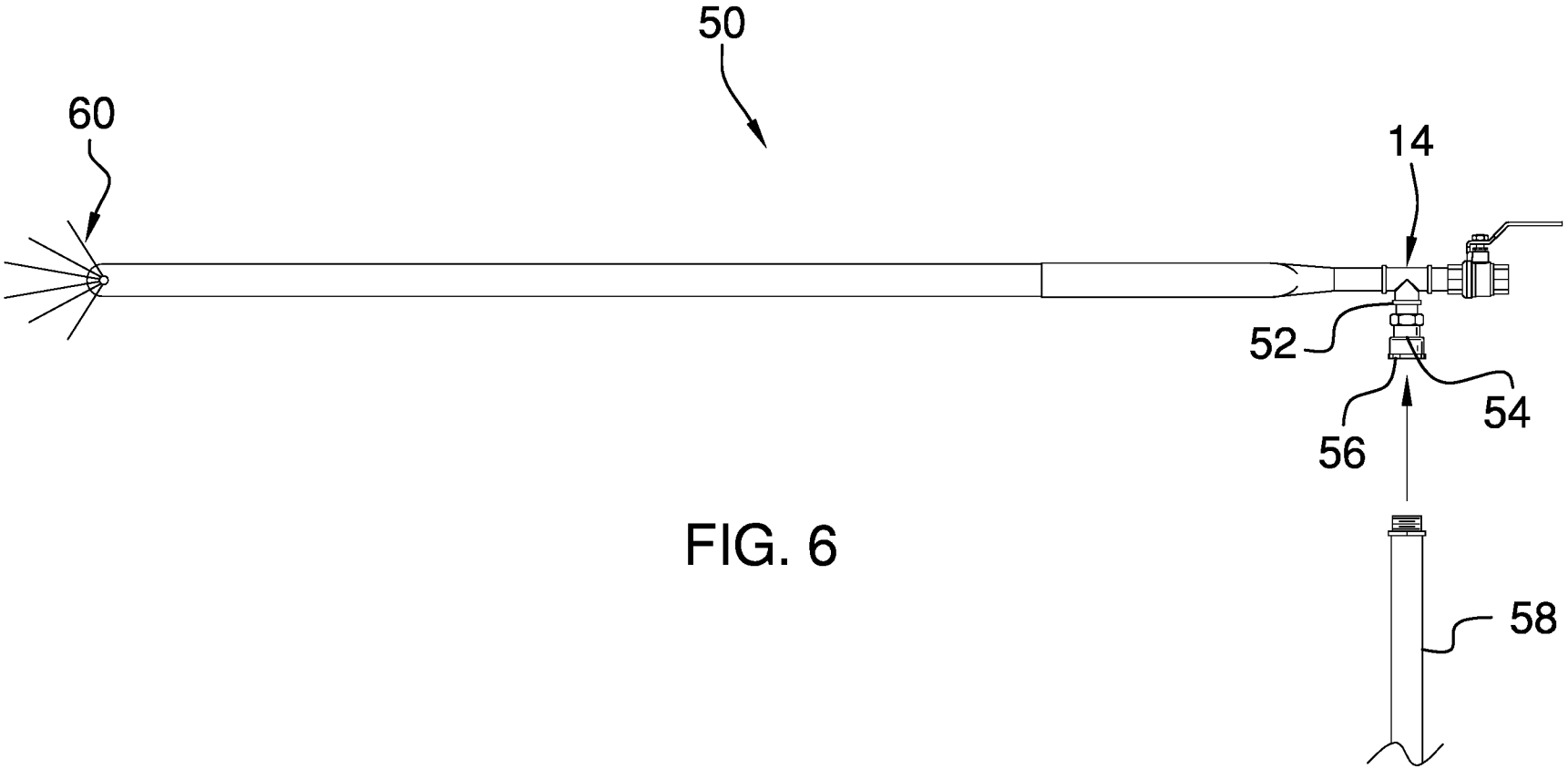
FIG. 6 is a perspective view of an alternative embodiment of the disclosure.

In an alternative embodiment 50 as is most clearly shown in FIG. 6, the blowing tube 12 has a fluid inlet 52 that is integrated into the outer wall 26 associated with the tubular portion 14. The fluid inlet 52 is positioned between the outlet 40 of the valve 36 and the threshold 32 between the tubular portion 14 and the fin portion 16. Additionally, the fluid inlet 52 has a distal end 54 with respect to the outer wall 26. The fluid inlet 52 has a female hose coupler 56 that is disposed on the distal end 54 thereby facilitating the female hose coupler 54 to be fluidly coupled to a fluid hose 58. In this way the fluid inlet 52 can deliver a fluid 60 into the blowing tube 12 in lieu of the compressed air. The fluid 60 may be water or other type of fluid that will not damage or corrode the radiator 18.

In use, the air hose 44 is attached to the inlet of the valve 36 and the blowing tube 12 is manipulated to extend the fin portion 16 downwardly along the radiator 18. Furthermore, the blowing tube 12 is positioned such that the air hole 20 is directed toward the radiator 18. The valve 36 is positioned in the open condition to facilitate compressed air 46 to blow outwardly through the air hole 20. In this way the compressed air 46 can dislodge dirt and debris that have collected in the radiator 18 thereby enhancing operational efficiency of the radiator 18. Additionally, the valve 36 can be adjusted to facilitate a desired volume of the compressed air 46 to be delivered outwardly through the air hole 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A radiator cleaning assembly for blowing compressed air through a radiator for cleaning debris from the radiator, said assembly comprising:

a blowing tube having a tubular portion and a fin portion being flattened thereby facilitating said fin portion to be positioned adjacent to a radiator without damaging the radiator, said fin portion having an air hole extending into an interior of said blowing tube, said air hole being distally positioned with respect to said tubular portion;

a valve being integrated into said blowing tube, said valve being positioned on said tubular portion, said valve being positionable in an open condition wherein said valve is configured to pass air into said blowing tube, said valve being positionable in a closed condition wherein said valve is configured to inhibit air from passing into said blowing tube;

an air hose being fluidly coupled to said valve, said air hose being fluidly coupled to a source of compressed air to deliver compressed air to said valve, said valve delivering the compressed air to said air hole in said blowing tube when said valve is in said open condition thereby facilitating the compressed air to dislodge dirt and debris from the radiator when said blowing tube is positioned next to the radiator;

wherein said blowing tube has a first end, a second end and an outer wall extending between said first end and said second end, said first end being associated with said tubular portion, said first end being open, said second end being associated with said fin portion, said second end being closed, said outer wall associated with said tubular portion being continuously arcuate about an axis extending between said first end and said second end such that said tubular portion defines a cylindrical shape, said outer wall associated with said fin portion being flattened to define a first lateral side of said outer wall associated with said fin portion and a second side of said outer wall associated with said fin portion, said first lateral side lying on a plane being oriented parallel with said second lateral side having said first lateral side being spaced from said second lateral side; and a sleeve being wrapped around said blowing tube, said sleeve being positioned to extend across said threshold of said outer wall between said tubular portion and said fin portion, said sleeve conforming to a shape of said outer wall extending over portions of both the tubular portion and the fin portion.

2. The assembly according to claim 1, wherein said outer wall has a threshold between said tubular portion and said fin portion, each of said first lateral side and said second lateral side extending between said threshold and said second end of said blowing tube, said threshold being positioned closer to said first end than said second end, said air hole extending through said first lateral side, said air hole being positioned proximate said second end.

3. The assembly according to claim 1, wherein said second end is rounded thereby inhibiting said second end from damaging the radiator when said second end inadvertently comes into contact with the radiator.

4. The assembly according to claim 1, wherein said valve has an input and an outlet, said outlet being fluidly coupled to said first end of said blowing tube, said valve having a handle being rotatably attached to said valve, said handle being in mechanical communication with said valve for urging said valve between said open condition and said closed condition when said handle is manipulated.

5. A radiator cleaning assembly for blowing compressed air through a radiator for cleaning debris from the radiator, said assembly comprising:

a blowing tube having a tubular portion and a fin portion being flattened thereby facilitating said fin portion to be positioned adjacent to a radiator without damaging the radiator, said fin portion having an air hole extending into an interior of said blowing tube, said air hole being distally positioned with respect to said tubular portion, said blowing tube having a first end, a second end and an outer wall extending between said first end and said second end, said first end being associated with said tubular portion, said first end being open, said second end being associated with said fin portion, said second end being closed, said outer wall associated with said tubular portion being continuously arcuate about an axis extending between said first end and said second end such that said tubular portion defines a cylindrical shape, said outer wall associated with said fin portion being flattened to define a first lateral side of said outer wall associated with said fin portion and a second side of said outer wall associated with said fin portion, said first lateral side lying on a plane being oriented parallel with said second lateral side having said first lateral side being spaced from said second lateral side, said outer wall having a threshold between said tubular portion and said fin portion, each of said first lateral side and said second lateral side extending between said threshold and said second end of said blowing tube, said threshold being positioned closer to said first end than said second end, said air hole extending through said first lateral side, said air hole being positioned proximate said second end, said second end being rounded thereby inhibiting said second end from damaging the radiator when said second end inadvertently comes into contact with the radiator;

a sleeve being wrapped around said blowing tube, said sleeve being positioned to extend across said threshold of said outer wall between said tubular portion and said fin portion, said sleeve conforming to a shape of said outer wall extending over portions of both the tubular portion and the fin portion;

a valve being integrated into said blowing tube, said valve being positioned on said tubular portion, said valve being positionable in an open condition wherein said valve is configured to pass air into said blowing tube, said valve being positionable in a closed condition wherein said valve is configured to inhibit air from passing into said blowing tube, said valve having an input and an outlet, said outlet being fluidly coupled to said first end of said blowing tube, said valve having a handle being rotatably attached to said valve, said handle being in mechanical communication with said valve for urging said valve between said open condition and said closed condition when said handle is manipulated; and an air hose being fluidly coupled to said valve, said air hose being fluidly coupled to a source of compressed air to deliver compressed air to said valve, said valve delivering the compressed air to said air hole in said blowing tube when said valve is in said open condition thereby facilitating the compressed air to dislodge dirt and debris from the radiator when said blowing tube is positioned next to the radiator, said air hose having a primary end being fluidly coupled to said inlet of said valve.

6. The assembly according to claim 5, wherein said blowing tube has a fluid inlet being integrated into said outer wall associated with said tubular portion, said fluid inlet being positioned between said outlet of said valve and said threshold between said tubular portion and said fin portion, said fluid inlet having a distal end with respect to said outer wall, said fluid inlet having a female hose coupler being disposed on said distal end thereby facilitating said female hose coupler to be fluidly coupled to a fluid hose wherein said fluid inlet is configured to deliver a fluid into said blowing tube in lieu of the compressed air.

* * * * *